US008595863B1

(12) United States Patent
Lamprey

(10) Patent No.: US 8,595,863 B1
(45) Date of Patent: Dec. 3, 2013

(54) PROTECTIVE COVERING FOR CONSTRUCTION STILTS

(75) Inventor: Jason A. Lamprey, North Grosvenordale, CT (US)

(73) Assignee: J.L. Plastering LLC, North Grosvenordale, CT (US)

( * ) Notice: Subject to any disclaimer, the term of this patent is extended or adjusted under 35 U.S.C. 154(b) by 840 days.

(21) Appl. No.: 12/628,576

(22) Filed: Dec. 1, 2009

(51) Int. Cl.
*A41D 17/00* (2006.01)
*A43B 23/00* (2006.01)

(52) U.S. Cl.
USPC ..... 2/46; 36/70 R; 482/148; 150/154

(58) Field of Classification Search
USPC ..... 150/154; 2/22, 46, 54; 482/75, 76, 148, 482/77; 36/7.1 R, 7.5, 81, 70 R
See application file for complete search history.

(56) References Cited

U.S. PATENT DOCUMENTS 1,004,812 A * 10/1911 Pfouts ..... 36/2 R
2,717,387 A * 9/1955 McMahan ..... 2/22
2,872,745 A * 2/1959 Finegan ..... 36/2 R
3,201,876 A * 8/1965 Leumi ..... 36/7.5
3,595,339 A * 7/1971 Ballard et al. ..... 182/230
3,626,609 A * 12/1971 Cramer ..... 36/7.5
4,057,853 A * 11/1977 McLane ..... 2/22
4,088,336 A * 5/1978 Chapel ..... 280/11.19
4,461,098 A * 7/1984 Diegelman ..... 36/2 R
4,516,336 A * 5/1985 Nissenbaum ..... 36/7.1 R
5,165,182 A * 11/1992 Michael ..... 36/1.5
5,441,064 A * 8/1995 Becker et al. ..... 135/16
5,514,054 A * 5/1996 Rowan ..... 482/75
5,815,948 A * 10/1998 Dzielak ..... 36/2 R
6,205,593 B1 * 3/2001 Schaub, Jr. ..... 2/242
D520,218 S * 5/2006 Mayers ..... D2/901
2007/0270288 A1 * 11/2007 Hansard ..... 482/75

* cited by examiner

*Primary Examiner* — Sue A Weaver
(74) *Attorney, Agent, or Firm* — Chapin IP Law, LLC

(57) ABSTRACT

A protective covering for a stilt is presented. The protective covering includes a cylinder of flexible material. The protective covering also includes a first securing element disposed along a lower portion of the covering for retaining a lower opening of the cylinder of flexible material proximate a foot of the stilt. The protective covering further includes a second securing element disposed along an upper portion of the cylinder for securing an upper opening of the cylinder of flexible material proximate a calf of a wearer of the stilt.

8 Claims, 2 Drawing Sheets

PROTECTIVE COVERING FOR CONSTRUCTION STILTS

BACKGROUND

Plasterers commonly wear stilts in order to reach the ceilings and high parts of walls while performing their services. The stilts are strapped to the legs of the user so that the person can easily reach high locations without the need to climb up and down a ladder or scaffolding. In order to provide proper balance and maximum support, the stilts include a complicated structure made up of multiple parts. However, plastering can be a messy project. Plaster can be dropped and plaster dust gets in the air. Therefore, the stilts commonly get coated with plaster debris. This causes the stilts to deteriorate and fail. Since stilts are expensive, a major cost to the plasterer is replacing stilts that have failed due to plaster and plaster debris on the stilts. Therefore, a need exists for a device to prevent plaster and plaster debris from coming into contact with the stilts during the plastering process. Similarly, stilts are used for other construction trades, including insulators, painters, board hangers, and drywall tapers. These trades also generate debris that adheres to and damages stilts. Therefore, a need exists for a device to prevent damage to stilts from any construction activity.

SUMMARY

Embodiments of the presently disclosed protective covering for construction stilts provide a structure for protecting stilts used in plastering and other construction trades. According to one aspect of the invention, the structure includes a protective covering over the stilts and feet of the wearer. According to another aspect of the invention, the protective covering up is made of a fabric material. According to another aspect and invention, the protective covering includes an attachment at the bottom of the covering to connect to the stilts to prevent plaster and plaster debris from entering within the protective covering. According to another aspect of invention, the protective covering includes a portion that extends across a leg of the wearer.

Note that each of the different features, techniques, configurations, etc. discussed in this disclosure can be executed independently or in combination. Accordingly, the present invention can be embodied and viewed in many different ways. Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

The present invention provides a protective covering for plastering stilts. While the term plastering stilts Is used herein, it should be appreciated that the present protective covering for construction stilts applies to stilts for other trades, including but not limited to, insulators, painters, board hangers, and drywall tapers.

Figure 1:
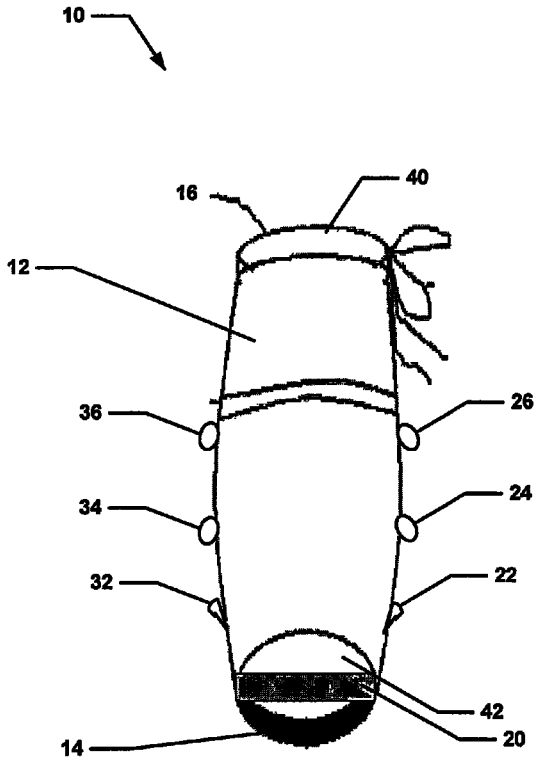
FIG. 1 is a front view of a protective covering for a construction stilt according to an embodiment of invention.

Referring now to FIG. 1, a particular embodiment of a protective covering for construction stilts 10 is shown. The protective covering 10 is formed as a cylindrical bag of flexible material 12 having an upper 40 and a lower opening 42. The lower opening 42 includes a first securing element 14 disposed along a lower portion of said covering 12 for retaining the lower opening 42 of the cylinder of flexible material 12 proximate a foot of the stilt. In this embodiment the first securing element is realized as a piece of elastic material, though it could be implemented in various other ways, for example by a drawstring or hook and loop fastener (e.g. Velcro®). The protective covering for a stilt 10 in certain embodiments may also include a strap 20 disposed across the lower opening 42 of the cylinder of flexible material 12.

The upper opening 40 of the cylindrical bag of flexible material 12 has a second securing element 16 disposed along an upper portion for securing the upper opening 40 of the cylinder of flexible material 12 proximate a calf of a wearer of the stilt. In this embodiment the second securing element is realized as a drawstring, though it could be implemented in various other ways, for example by a hook and loop fastener (e.g. Velcro®) or via a piece of elastic material.

The cylinder of flexible material 12 is preferably comprised of waterproof material to protect the stilt from moisture. Additionally, the cylinder of flexible material is preferably comprised of dustproof material to protect the stilt form dust and other debris.

The protective covering for a stilt 10 may further include a first length adjustment mechanism disposed along one side of the cylinder of flexible material 12. The first adjustment mechanism comprises a clip 22 capable of being in mechanical communication with one of a plurality of rings 24 and 26 disposed a predetermined distance away from each other. The protective covering for a stilt 10 may also include a second length adjustment mechanism disposed along an opposite side of the cylinder of flexible material 12 as said first length adjustment mechanism. The second adjustment mechanism comprises a clip 32 capable of being in mechanical communication with one of a plurality of rings 34 and 36 disposed a predetermined distance away from each other. While only two rings are shown, it should be appreciated that any number of rings could be used to provide different length adjustments.

Figure 2:
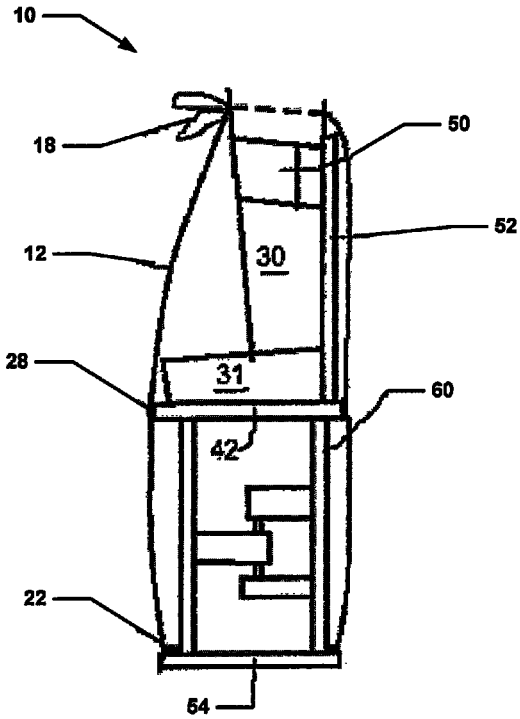
FIG. 2 is a cross sectional view of the protective covering for a construction stilt of FIG. 1 on a plastering stilt in accordance with embodiments of the invention.

Referring now to FIG. 2, a cross sectional view of the protective covering for a construction stilt 10 on a plastering stilt is shown. As is known in the art, a stilt includes a foot 42, a spaced apart base 60, a support 43 and a strap 50. The wearer places his foot 31 on the base 60 so that the leg 30 extends along the support 52. The strap 50 connects the support 52 to the calf of the wearer. Other straps may be included to connect to the foot or ankle as well as the calf. As is illustrated in FIG. 2, the protective covering 12 is positioned around the stilt. The elastic 16 maintains the lower opening around the stilt near the stilt bottom 54. The drawstring 18 at the upper opening tightens the protective covering 12 around the calf of the wearer above the strap 50. In this manner the entire stilt, except for the stilt bottom 54, is enclosed within the protective covering 12. When used in this manner, the wearer can remove the stilt while a lower portion of the stilt remains covered by the protective covering 12. After attaching the stilt° to his or her leg, the wearer lifts an upper portion of the protective covering 12 over the top part of the stilt and tightens the drawstring Preferably, the protective covering 12 his formed of a closely woven fabric to prevent the plaster and debris from passing through the protective covering 1. The protective covering 1 may also be treated with a plastic or other material on the exterior or interior surface in order to preclude any entry of plaster dust. Of course, other materials, such as polymers and plastics, which are sufficiently flexible for use of the stilts may be used for the protective covering. Having disclosed at least one embodiment of the present invention, various adaptations, modifications, additions, and improvements will be readily apparent to those of ordinary skill in the art. Such adaptations, modifications, additions and improvements are considered part of the invention which is only limited by the several claims attached hereto.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

What is claimed is:

1. A protective covering for a stilt, comprising:

a cylinder of flexible material;

a first securing element disposed along a lower portion of said cylinder for retaining a lower opening of said cylinder of flexible material proximate a foot of the stilt;

a second securing element disposed along an upper portion of said cylinder for securing an upper opening of said cylinder of flexible material proximate a support of the stilt connectable to a calf of a wearer of the stilt; and a first length adjustment mechanism disposed along one side of said cylinder of flexible material, wherein said first length adjustment mechanism comprises a clip capable of being in mechanical communication with one of a plurality of rings disposed along a length of the cylinder of flexible material a predetermined distance away from each other.

2. The protective covering for a stilt of claim 1 wherein said first securing element is selected from the group consisting of a drawstring, elastic, and a hook and loop fastener.

3. The protective covering for a stilt of claim 1 wherein said second securing element is selected from the group consisting of a drawstring, elastic, and a hook and loop fastener.

4. The protective covering for a stilt of claim 1 wherein said cylinder of flexible material comprises a cylinder of waterproof material.

5. The protective covering for a stilt of claim 1 wherein said cylinder of flexible material comprises a cylinder of dustproof material.

6. The protective covering for a stilt of claim 1 further comprising a second length adjustment mechanism disposed along an opposite side of said cylinder of flexible material as said first length adjustment mechanism.

7. The protective covering for a stilt of claim 6 wherein said second adjustment mechanism comprises a clip capable of being in mechanical communication with one of a plurality of rings disposed a predetermined distance away from each other.

8. The protective covering for a stilt of claim 1 further comprising a strap disposed across a bottom opening of said cylinder of flexible material.

* * * * *